US006668142B2

(12) United States Patent
Nakaue et al.

(10) Patent No.: US 6,668,142 B2
(45) Date of Patent: Dec. 23, 2003

(54) IMAGE FORMING APPARATUS WITH REFERENCE DENSITY CHANGED ACCORDING TO LOW FREQUENT AND HIGH FREQUENT MODES

(75) Inventors: Takahisa Nakaue, Kobe (JP); Tetsuro Tomoe, Koryo-cho (JP); Kenichi Tanabe, Hirakata (JP); Akane Kikuta, Neyagawa (JP)

(73) Assignee: Kyocera Mita Corporation, Osaka (JP)

( * ) Notice: Subject to any disclaimer, the term of this patent is extended or adjusted under 35 U.S.C. 154(b) by 0 days.

(21) Appl. No.: 10/303,418

(22) Filed: Nov. 25, 2002

(65) Prior Publication Data

US 2003/0103776 A1 Jun. 5, 2003

(30) Foreign Application Priority Data

Nov. 30, 2001 (JP) ..... 2001-365698

(51) Int. Cl.[7] ..... G03G 15/08; G03G 15/00

(52) U.S. Cl. ..... 399/43; 399/59; 399/138

(58) Field of Search ..... 399/43, 58, 59, 399/82, 138

(56) References Cited

FOREIGN PATENT DOCUMENTS

| | | | |
|---|---|---|---|
| JP | 63-243980 A | * | 10/1988 |
| JP | 5-45986 A | * | 2/1993 |
| JP | 11-153936 A | * | 6/1999 |

* cited by examiner

*Primary Examiner*—Joan Pendergrass
(74) *Attorney, Agent, or Firm*—Jordan and Hamburg LLP

(57) ABSTRACT

An image forming apparatus is able to maintain an image density at a constant level. The apparatus has a FC mode selecting key for allowing a user to selectively designate a low FC mode indicating that the apparatus is in a less-used state where the number of times of image formation is smaller than a predetermined value and a high FC mode indicating that the apparatus is in a highly-used state where the number of times of image formation is not smaller than the predetermined value, and a CPU for correctively setting a target value of toner density at a value higher than a target value of toner density at the low FC mode when the apparatus is in the high FC mode.

11 Claims, 6 Drawing Sheets

IMAGE FORMING APPARATUS WITH REFERENCE DENSITY CHANGED ACCORDING TO LOW FREQUENT AND HIGH FREQUENT MODES

BACKGROUND OF THE INVENTION

1. Field of the Invention

This invention relates to an image forming apparatus such as a copier, a printer, and a facsimile machine.

2. Description of the Related Art

Generally, in a copier using a so-called two-component developing agent consisting of toner and carriers, toner is gradually consumed as developing is proceeded with the result that the toner density, which is a mixing ratio of toner to carrier, lowers. As the toner density is lowered, the density of a copied image is lowered with the result that the quality of image formation may be deteriorated. In view of this, it is necessary to replenish toner by the consumed amount of toner accompanied by development in order to maintain the toner density at a constant level. An example of toner density controlling method is to detect the amount of toner in the developing agent and to replenish toner in such a manner that the detected value is controlled to be a target value.

However, even if the toner density is regulated at a constant value, it is not always the case that the image density for image formation is set at constant level because the number of times of image formation (copying) varies depending on users. It is often the case that a certain correction amount is added to the target value for toner density control.

More specifically, copying demand of users using a copier varies case by case. Some users may demand copying as less as about 1,500 to 3,000 sheets per month. Hereinafter, such a user of less demand is called "low frequent copy-making user (low-FC user)". On the other hand, there may be a user who uses the copier as many as 3,000 sheets or more per month. Hereinafter, such a heavy user is called a high frequent copy-making user ("high FC user").

It has been customarily believed it desirable for low FC users to use copiers exclusively designed for low FC users (or low FC-oriented copiers) and for high FC users to use copiers exclusively designed for high FC users (or high FC-oriented copiers), wherein the low FC-oriented copier is designed such that a target value of toner density is set at a certain level lower than a level set for the high FC-oriented copier, whereas the high FC-oriented copier is designed such that a target value of the toner density is set at a level higher than the level set for the low FC-oriented copier.

However, such a high FC-oriented copier is expensive, and it is often the case that many users tend to purchase a low FC-oriented copier because they are not certain whether they are a high FC user or a low FC user at the time of purchasing.

Even if a user purchased a low FC-oriented copier, there may be a case that the user is required to make a large number of copying, i.e., using the low FC-oriented copier as the high FC-oriented copier, in the course of using the copier. In such a case, the user encounters a drawback that a sufficient correction amount may not be added to a target value of toner density at the start-up time of the copier with the result that the image density may be lowered as image formation (developing) proceeds, as shown in the dot-dash (chain) line in FIG. 7. It has been believed that occurrence of such a phenomenon is caused by insufficient charging of a photosensitive drum. The insufficient charging of the photosensitive drum can be overcome as time lapses after start-up of the copier, and desirable copying regarding the image density, even when the low FC-oriented copier is used as the high FC-oriented copier, is executable upon lapse of a certain time after start-up of the copier. However, in the conventional low FC oriented copier, the time required for the copier to enable producing the desired image density when used as the high FC-oriented copier, after start-up of the copier cannot be shortened despite the existence of needs by the users.

SUMMARY OF THE INVENTION

In view of the above, it is an object of this invention to provide an image forming apparatus that enables to maintain an image density for image formation at a satisfactory level.

In order to achieve the above object, according to an aspect of this invention, an image forming apparatus comprises a toner density detector for detecting a density of toner contained in a two-component developing agent adapted to be used in image formation; a toner density controller for controllably setting (adjusting) the toner density detected by the toner density detector to equal a target value; a mode selector for allowing a user to selectively designate a low frequent copying (FC) mode indicating that the image forming apparatus is in a less-used state where the number of times of image formation is smaller than a predetermined value and a high FC mode indicating that the image forming apparatus is in a highly-used state where the number of times of image formation is not smaller than the predetermined value; and a toner density corrector for correcting the target value of the toner density in such a manner that the toner density controller controllably sets (adjusts) the toner density to equal a target value higher than a target value when the image forming apparatus is in the low FC mode in response to designation of the high FC mode by the mode selector.

In the above arrangement, the toner density corrector corrects the target value of toner density in such a manner that the toner density controller sets the toner density at the target value higher than the target value when the image forming apparatus is in the low FC mode in response to designation of the high FC mode. Accordingly, even if a user uses the image forming apparatus, which is initially set in the low FC mode, at the high FC mode, there is no likelihood that a correction amount to be added to the target value of toner density is insufficient at an initial stage of image formation, thereby lowering image density. In the above arrangement, since image density of a certain desired level is ensured even at an initial stage of image formation, a desirable image quality is ensured in the initial stage of the image formation, and the time required for the apparatus to enable generation of the desired image density even when the apparatus is used as high FC oriented copier after start-up of the apparatus will be shortened and thus the usability of the apparatus is improved. The downside effects due to the insufficient charging of the photosensitive drum in the early stage of the copy making operation are magnified when the apparatus is used in high FC mode, i.e., a large number of copying making operation. However, by setting the apparatus to a high FC mode, i.e., setting a higher toner density target value, at the beginning of the large number copy making operation, the aforementioned downside effects can be alleviated.

These and other objects, features and advantages of the present invention will become more apparent upon a reading of the following detailed description and accompanying drawing.

DESCRIPTION OF THE PREFERRED EMBODIMENTS (First Embodiment)

Figure 1:
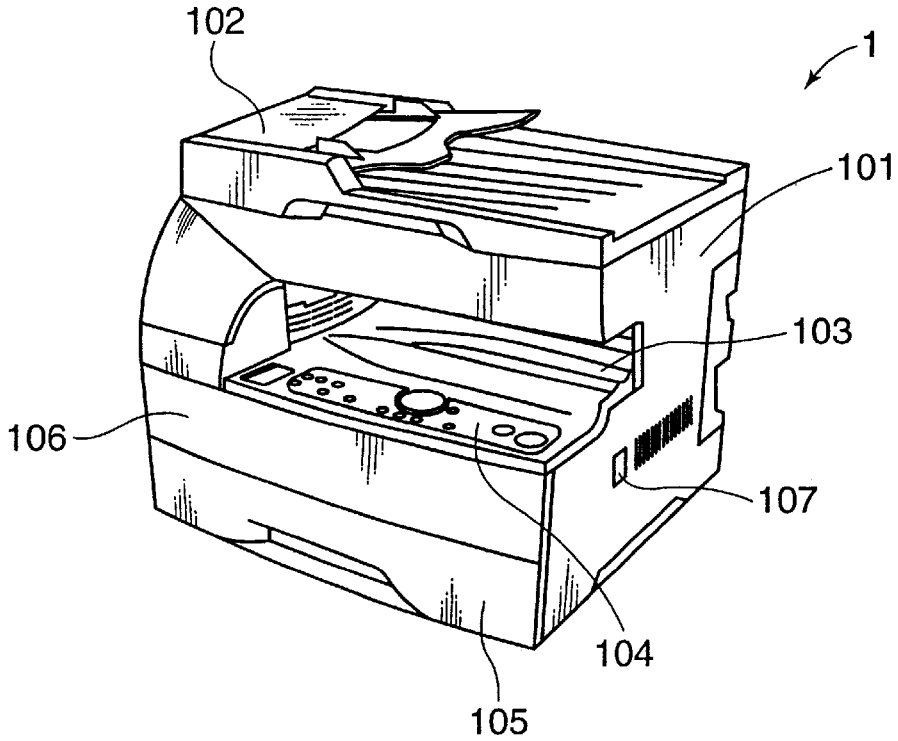
FIG. 1 is a perspective view showing an external appearance of a copier in accordance with first and second embodiments of this invention.
Figure 2:
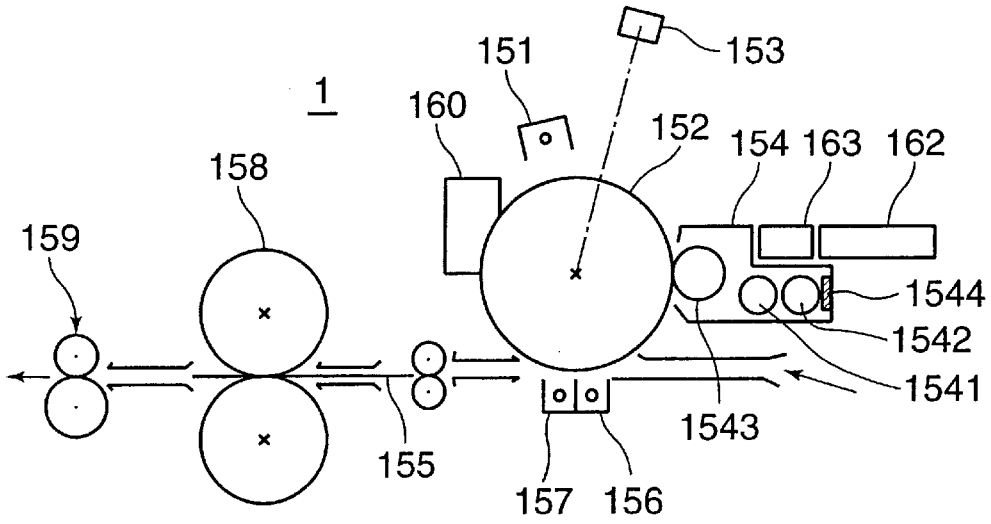
FIG. 2 is a schematic illustration showing an internal arrangement of the copier in accordance with the first and second embodiments.

Described is a first embodiment in accordance with this invention with reference to FIGS. 1 through 7. FIG. 1 is a perspective view showing an external appearance of a copier in accordance with the first embodiment of this invention. FIG. 2 is a schematic illustration showing an internal arrangement of the copier. It should be appreciated that although in FIG. 2, a transport path of a copy sheet is oriented in a horizontal direction for easy understanding, the transport path is oriented in a vertical direction in an actual arrangement of the copier shown in FIG. 1.

As shown in FIG. 1, the copier 1, as an example of image forming apparatus, includes a generally box-shaped copier main body 101, a document reader 102 provided at an upper part of the main body 101, a discharge section 103 and an operating section 104 each provided at an intermediate part of the main body 101, and a sheet storage section 105 provided at a lower part of the main body 101. A user is accessible to the interior of the main body 101 by opening a front cover 106. The main body 101 is further provided with a main switch 107.

The internal arrangement of the copier main body 101 is, as shown, for example, in FIG. 2. Referring to FIG. 2, in the copier main body 101, the surface of a photosensitive drum 152 is uniformly charged by a charger 151. When the document reader 102 reads the image of original document, and a laser beam bearing the data of the read image and emitted from an exposure unit 153 irradiates the surface of the photosensitive drum 152, an electrostatic latent image is formed on the surface of the photosensitive drum 152, and toner is adhered to the latent image by the developing unit 154 to develop a toner image from the latent image. As timed with the image developing, a copy sheet 155 is fed from the sheet storage section 105 to the photosensitive drum 152 bearing the toner image on the surface thereof. The toner image is transferred to the copy sheet 155 from the surface of the photosensitive drum 152 by a transferring unit 156. Note that the low FC-oriented copier hereinafter described in this specification has the photosensitive drum 152 with a diameter generally less than or equal to 50 mm. The low FC-oriented copier also includes the copier having the photosensitive drum with a diameter less than or equal 30 mm. Another physical parameter to define the low FC-oriented copier throughout this specification includes a feeding speed of copy sheet that is 20 (twenty) A4-size sheets per minute or less than 20 sheets per minute. Note that, in the above description of the feeding speed, the orientation of the A4-size sheet is such that a shorter side of the A4-size sheet aligns along the paper feeding direction and thus the longer side of the A4-size sheet is orthogonal to the paper feeding direction.

After the image transfer, the copy sheet 155 is separated from the photosensitive drum 152 by a separating unit 157, and is transported to a fixing unit 158 provided with a fixing roller (heat roller) where the toner image is fixed on the copy sheet 155. After the image fixation, the copy sheet 155 is discharged onto the discharge section 103 by a pair of discharge rollers 159. The main body 101 further includes a cleaning unit 160 for removing toner residuals on the surface of the photosensitive drum 152 therefrom, a toner hopper 162 for storing toner therein to be replenished to the developing unit 154, and a developing agent hopper 163 for sealably containing a developing agent as an initiator therein. The developing agent is a two-component agent consisting of toner and carriers in a mixed state.

The developing unit 154 is adapted to adjust image density for image formation, as well as forming a toner image by adhering toner onto the surface of the photosensitive drum 152 bearing a latent image. The developing unit 154 is internally provided with agitating rollers 1541, 1542, and a developing roller 1543 arranged side by side one another. The agitating rollers 1541, 1542 are drivingly rotated by a main motor 1701, which is described later, in relation to the developing roller 1543.

The developing roller 1543 is opposingly arranged to the photosensitive drum 152, and is internally provided with an un-rotatable permanent magnet (not shown). The permanent magnet causes the surface of the developing roller 1543 to function as a so-called magnetic brush, as described below.

More specifically, the developing agent loaded from the developing agent hopper 163 to the developing unit 154 is circulated inside the developing unit 1543 by the rotation of the agitating rollers 1541, 1542 for agitating the developing agent. In circulation, toner in the developing agent is adhered to the surface of the photosensitive drum 152 bearing a latent image aided by the magnetic attraction between the permanent magnet in the developing roller 1543 and the carriers in the developing agent with its movement being regulated by a regulating blade (not shown) provided at an appropriate position on the developing roller 1543. Thus, the developing roller 1543 serves as a magnetic brush and supplies toner onto the surface of the photosensitive drum 152, and toner is consumed while being magnetically attracted to the surface of the photosensitive drum 152 bearing the electrostatic latent image.

A toner sensor 1544 serving as a toner density detector is arranged at an appropriate position on an inner wall of the developing unit 154. The toner sensor 1544 is adapted to detect the toner density of the developing agent. For example, the toner sensor 1544 detects a variation of magnetic permeability. Toner density is regulated, which is described later in detail, by replenishing toner from the toner hopper 162 to the developing unit 154 through an unillustrated replenishing port formed in the toner hopper 162 in such a manner that the toner density detected by the toner sensor 1544 is controllably set to equal a target value.

The method of adjusting image density for image formation in the developing unit 154 utilizes a phenomenon that an amount of toner adhered to the surface of the photosensitive drum 152 bearing a latent image is varied by changing a bias voltage applied to the developing unit 154, thereby leading to variation of image density (namely, the higher the bias voltage, the less the image density of a copied image is).

Figure 3:
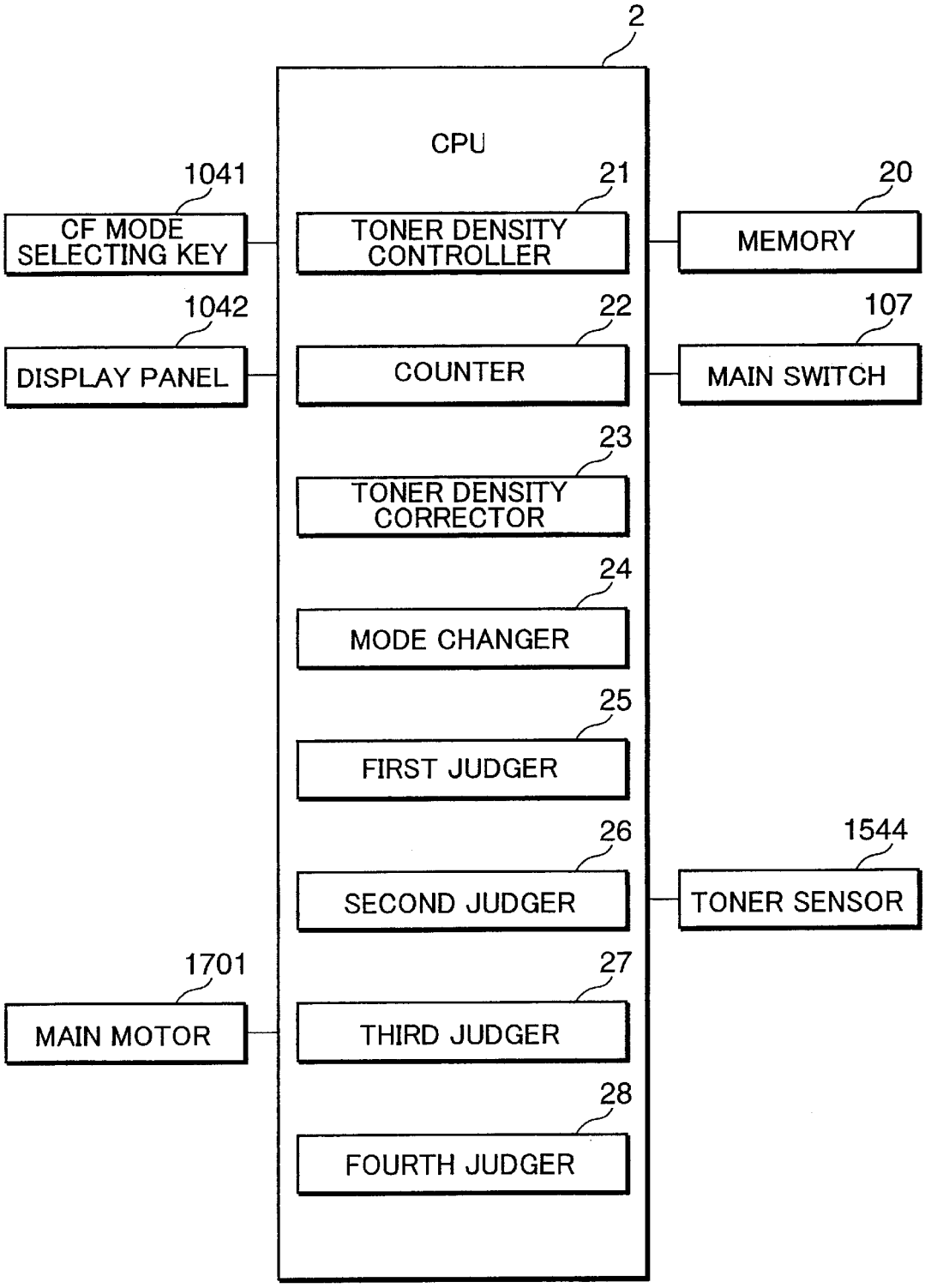
FIG. 3 is a block diagram showing a control system in relation to a developing unit of the copier in accordance with the first embodiment.

Referring to FIG. 3, the operating section 104 is provided with a FC mode selecting key 1041, and a display panel 1042 serving as a display section for displaying a message or its equivalent thereon that aids a user to designate the mode selection with the FC mode selecting key 1041. The FC mode selecting key 1041 allows a user to selectively designate a low FC mode where frequency of copying (frequency of image formation frequency) is smaller than a predetermined value (e.g., 1,500 to 3,000 sheets per month) and a high FC mode where the frequency of copying (frequency of image formation) is not smaller than the predetermined value (e.g., 3,000 sheets or more per month). In this embodiment, the predetermined value is an adequate number "n" (an integer) selected from a range of 1,500 to 3,000 sheets per month. A message or equivalent display displayed on the display panel 1042 enables a user to designate the mode selection without fail.

FIG. 3 is a block diagram showing a control system of the copier 1 in relation to the developing unit 154. In the control system, a Central Processing Unit 2 (CPU2) serving as a main controller is connected to the FC mode selecting key 1041, the display panel 1042, the toner sensor 1544, and the main motor 1701. The main motor 1701 is adapted to drivingly rotate the photosensitive drum 152, the agitating rollers 1541, 1542, and the developing roller 1543 of the developing unit 154, and the like by way of a gear train or its equivalent.

The CPU 2 has a memory 20, a toner density controller 21, an image formation period counter 22, a toner density corrector 23, a mode changer 24, a first judger 25, a second judger 26, a third judger 27, and a fourth judger 28. The toner density controller 21 has a function of setting a toner density control value (target value of toner density) in accordance with an output from the toner sensor 1544 to control the toner density in the developing unit 154. The image formation period counter 22 counts a period of driving the developing unit 154 of the copier 1, namely, a period of driving the developing unit 154 for image formation. The toner density corrector 23 has a function of correcting the target value of toner density in such a manner that the toner density is controllably set to equal the target value of toner density to equal the high FC mode which is higher than the target value of toner density at the low FC mode in response to designation of the high FC mode by manipulation of the FC mode selecting key 1041. The mode changer 24 has a function of changing over the mode of the copier 1 from the high FC mode to the low FC mode when a time counted by the image formation period counter 22 reaches a predetermined value. The predetermined value is called "mode changeable timing" in this specification. The mode changeable timing is a timing beyond which it is conceived that the toner density will be excessively high under a continued operation of the copier 1 at the high FC mode, or a timing at which it is expected that the copier 1 is relieved of an insufficient charging status by lapse of a certain image formation period (developing unit driving period). The mode changeable timing is calculated in advance by actual measurement with respect to a copier before shipment. The first and second judgers 25, 26 each judge whether flags 1, 2, which will be described later, are in an ON-state. The third judger 27 judges whether a predetermined period has lapsed as a developing unit driving period. The fourth judger 28 judges whether printing is completed.

Each of the elements 21 through 28 is activated by an execution program, which is, for example, read out from the memory 20 and brought to an operable state in the CPU 2. As mentioned above, the mode changeable timing, which is a timing at which the mode changer 24 is allowed to change the copier 1 from the high FC mode to the low FC mode is a timing beyond which it is conceived that the toner density will be excessively high under a continued operation of the copier 1 at the high FC mode. The mode changeable timing can be calculated by actual measurement with respect to a copier before shipment.

Figure 4:
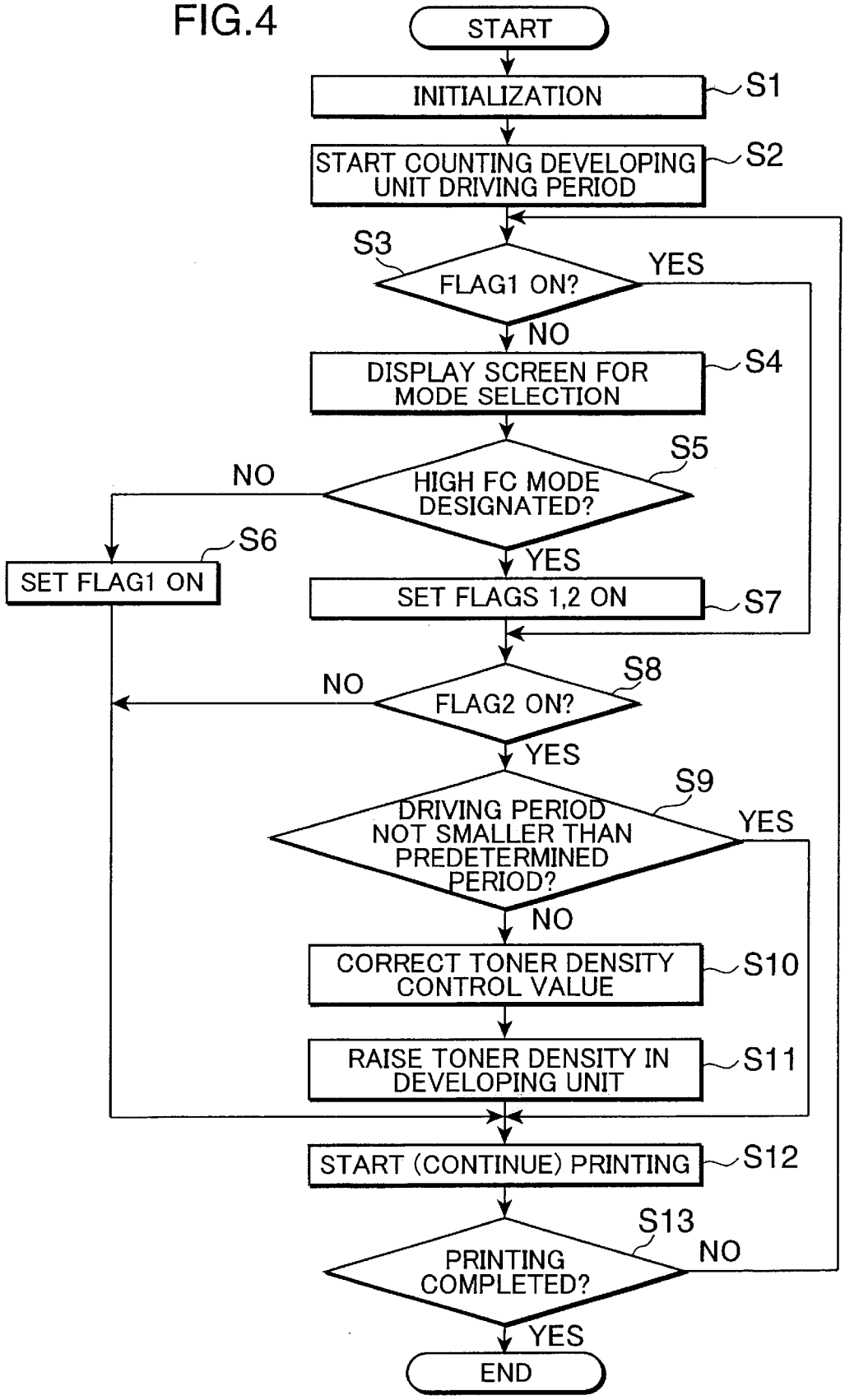
FIG. 4 is a flowchart showing a control operation of the copier in relation to the developing unit in the first embodiment.
Figure 5:
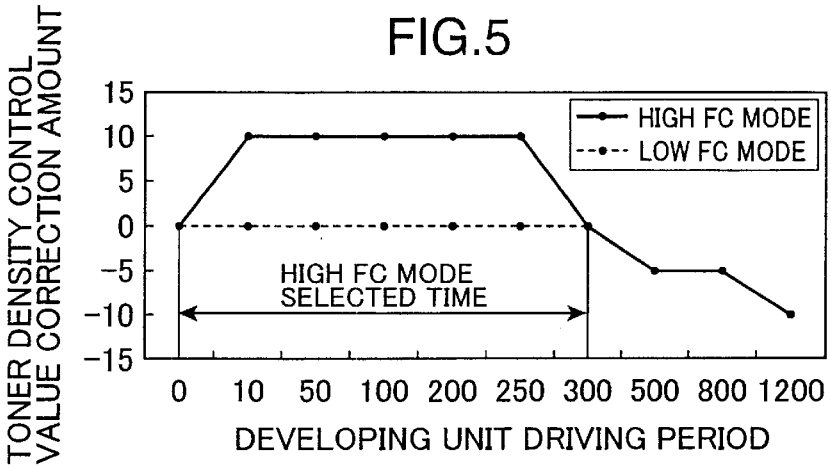
FIG. 5 is a graph showing a relationship between each correction amount of a toner density control value in a high FC mode and a low FC mode, and a developing unit driving period.
Figure 6:
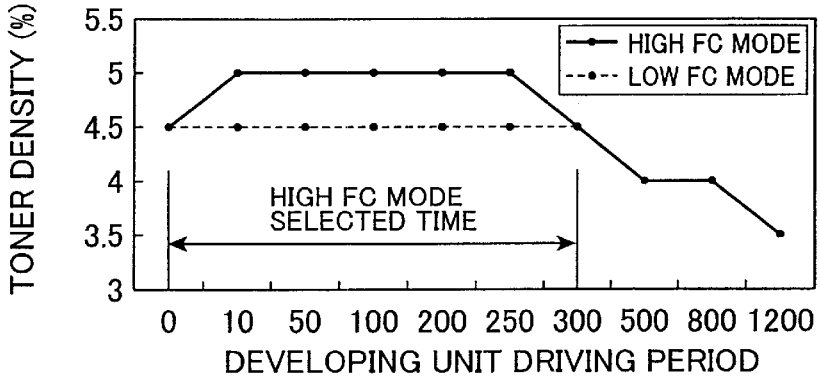
FIG. 6 is a graph showing a relationship between each toner density in the high FC mode and the low FC mode, and a developing unit driving period.
Figure 7:
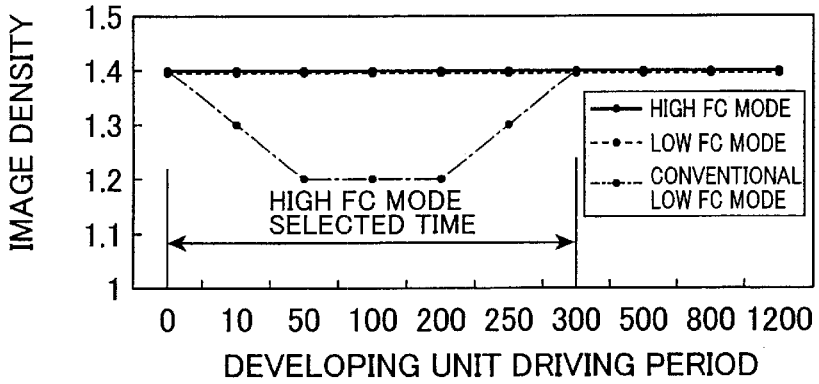
FIG. 7 is a graph showing a relationship between each image density for image formation in the high FC mode and the low FC modes, and a developing unit driving period.

FIG. 4 is a flowchart showing a control operation of the copier 1 in association with the developing unit 154. FIG. 5 is a graph showing a relationship between a correction amount of each toner density control value when image formation is carried out at the high FC mode and the low FC mode, and a developing unit driving period counted by the image formation period counter 22. FIG. 6 is a graph showing a relationship between each toner density of the developing unit when image formation is carried out at the high FC mode and the low FC mode, and a developing unit driving period. FIG. 7 is a graph showing a relationship between each image density for image formation when image formation is carried out at the high FC mode and the two different low FC modes, and a developing unit driving period.

Referring to FIG. 4, for instance, when a user turns on the main switch 107 to supply power to the copier 1, the copier 1 is initialized (Step S1). In the initialization, the flag 1 indicating that the control operation of the copier 1 is in the second loop or thereafter is set to an OFF-state, the flag 2 indicating that the high FC mode is selected is set to an OFF-state and a value of a developing unit driving period counted by the image formation period counter 22 is reset. These values are stored in the memory 20 as a default. Upon initialization, the copier 1 starts warming up. When the copier 1 is brought to a stand-by state ready for copying, the image formation period counter 22 starts counting a developing unit driving period (Step S2).

Then, the first judger 25 judges whether the flag 1 is set to an ON-state (Step S3). At the stage of initialization, the flag 1 is in an OFF state (NO in Step S3). Accordingly, a screen image for allowing a user to select the high FC mode or the low FC mode by the FC mode selecting key 1041 is displayed on the display panel 1042 (Step S4). Let's say that the user is a high FC user, and selects the high FC mode by the FC mode selecting key 1041 (Step S5). Then, the flag 1 and the flag 2 are respectively set to an ON-state (Step S7).

Subsequently, the second judger 26 judges whether the flag 2 is in an ON state (Step S8). Since the flag 2 is in an ON-state in Step S7 (YES in Step S8), the routine goes to Step S9.

In Step S9, the third judger 27 judges whether the developing unit driving period counted by the image formation period counter 22 reaches a predetermined value corresponding to the mode changeable timing (e.g., the predetermined value is 250 minutes including 30 minutes which is set in advance as a time necessary for keeping up with toner density variation). The predetermined value is also stored in advance in the memory 20. Since the period counted by the image formation period counter 22 in the first loop is normally shorter than the predetermined value, the toner density corrector 23 corrects the control value for toner density in the following manner (Step S10).

Specifically, as an example of the correction methods, the control value for toner density is increased from 0 bit to 10 bits during a developing unit driving period from 0 minute to 10 minutes, as shown by the solid line in FIG. 5. As the developing unit driving period lapses from 0 minute to 10 minutes, as shown in the solid line in FIG. 6, the toner density in the developing unit 154 is raised from 4.5% to 5% (Step S11). Thus, by setting the copier 1 to the high FC mode, the copier 1 can maintain the image density at a constant level, as illustrated by a solid line in FIG. 7, and the user is enabled to start printing with a satisfactory image density at the high FC mode (Step S12).

It should be noted, however, if the copier 1 is not set to the high FC mode at the beginning of the copying operation and the copier 1 is used in a high FC mode (highly frequent copy making operation), then the image density falls below the satisfactory level along a dot-dash (dashed) line shown in FIG. 7. The reason for raise of the image density level along the dot-dash (dashed) line shown in FIG. 7 after passage of around 200 minutes is due to the recovery of the charge of the photosensitive drum.

Next, the fourth judger 28 judges whether the printing is completed (Step S13). The judgment is made based on an output from a sheet sensor (not shown) provided at an appropriate position of the copier 1. When it is judged that the printing is completed (YES in Step S13), the routine ends, whereas when it is judged that the printing is not completed (NO in Step S13), the routine returns to Step S3.

When the routine returns to Step S3, the copier 1 enters the second loop of the routine. In the second loop, since the flag 1 is in an ON-state (YES in Step S3), the routine proceeds to Step S8 while skipping Steps S4 through S7. Specifically, as long as the user selects the high FC mode in the first loop, the user is not required to designate the high FC mode each time the copier 1 enters a new loop. It should be appreciated that the user may designate the high FC mode any time in the interim of the operation of the copier 1 to resume the high FC mode.

In Step S8, the second judger 26 judges whether the flag 2 is in an ON state. Since the flag 2 is in an ON state (YES in Step S8) in the second loop, the routine goes to Step S9.

In Step S9, it is judged whether the current developing unit driving period counted by the image formation period counter 22 is not smaller than the predetermined value (mode changeable timing). If it is judged that the counted value is smaller than the predetermined value (NO in Step S9), the control value for toner density is corrected in Step S10 (see FIG. 5), and the toner density in the developing unit 154 is raised in Step S11 (see FIG. 6). In contrast, if it is judged that the developing unit driving period counted by the image formation period counter 22 is equal to or larger than the predetermined value (YES in Step S9), the routine skips Steps S10, S11, and goes to Step S12. At this time, as shown, for example, by the solid line in FIG. 5, the control value for toner density is decreased from 10 bits to 0 bit during a developing unit driving period from 250 minutes to 300 minutes. As the developing unit driving period lapses from 250 minutes to 300 minutes, the toner density in the developing unit 154 is decreased from 5% to 4.5%, as shown by the solid line in FIG. 6. Note if the control value for the toner density was kept at 10 bits even after the time 250 min. (see FIG. 5), the toner density will be kept going up, resulting in generation of the image having the density level much higher than its satisfactory level. Thus, with the decrease of the toner density from 10 bits to 0 bit over the time period from 250 minutes to 300 minutes, the copier 1 is enabled to maintain its image density at a constant level, shown in solid line in FIG. 7, and the user is allowed to continue printing operation with the copier 1 being kept in the high FC mode (Step S12).

Then, the fourth judger 28 judges whether the printing is completed (Step S13). If it is judged that the printing is completed (YES in Step S13), the routine ends. If it is judged that the printing is not completed (NO in Step S13), the routine returns to Step S3 to initiate the control operation in the third loop of the routine. Thereafter, steps S3 through S12 are cyclically repeated until it is judged that the printing is completed in Step S13 (YES in Step S13).

Returning to Step S5 where the routine is in the first loop, it is to be assumed that the user is a low FC user, and did not select the high FC mode (NO in Step S5). In such a case, the routine goes directly to Step S12 after setting the flag 1 to an ON-state (Step S6) and, as shown by the broken line in FIG. 5, the control value for toner density is kept at 0 bit, and the toner density in the developing unit 154 is kept at 4.5% throughout a developing unit driving period from 0 minute to 300 minutes. In this case, since the copier 1 is in the low FC mode, the copier 1 is operated at a less-used state concerning the number of times of copying in accordance with the low FC mode. In this case, as a result, the copier 1 is enabled to maintain its image density at a constant level, as indicated by the dotted line in FIG. 7, and the user is allowed to continue printing in the low FC mode with satisfactory image density (Step S12). Then, the fourth judger 28 judges whether printing is completed (Step S13). If it is judged that the printing is completed (YES in Step S13), the routine ends. If it is judged that the printing is not completed (NO in Step S13), the routine returns to Step S3 to start the control operation in the second loop.

In the second loop, the first judger 25 judges whether the flag 1 is in an ON-state (Step S3). Since the flag 1 is in an ON-state in the second loop (YES in Step S3), the routine goes to Step S8 while skipping steps S4 through S7.

In Step S8, the second judger 26 judges whether the flag 2 is in an ON-state. Since the flag 2 is in an OFF-state in the second loop (NO in Step S8), the routine goes to Step S12 while skipping Steps S9 through S11. In Step S12, the printing is continued. Then, the fourth judger 28 judges whether the printing is completed (Step S13). If it is judged that the printing is completed (YES in Step S13), the routine ends. If it is judged that the printing is not completed (NO in Step S13), the routine returns to Step S3 to start the control operation in the third loop. Thereafter, steps S4 through S12 are cyclically repeated.

As mentioned above, according to the first embodiment, the target value of toner density is corrected in such a manner that the CPU2 controllably adjusts the toner density to equal a target value of toner density in the high FC mode, which is higher than the target value of toner density in the low FC mode, in response to designation of the high FC mode where the copier 1 is operable in the highly-used state where the number of times of copying is equal to or larger than the predetermined value, from the low FC mode where the copier 1 is operated in the less-used state where the number of times of copying is smaller than the predetermined value, by manipulation of the FC mode selecting key 1041.

In the above arrangement, even in a case where a high FC user uses the copier 1 initially set at the low FC mode, there is no likelihood that a correction amount for toner density control is insufficient at an initial stage of operating the copier, thereby lowering the image density. In the above arrangement, the copier 1 is enabled to maintain its image density generally at a constant level, and is enabled to form an image with desirable quality with a shortened stand-by period upon start-up of the copier 1, thus securing improved copying efficiency.

Further, according to the first embodiment of this invention, the image formation period counter 22 counts the developing unit driving period, and the copier 1 is automatically changed from the high FC mode to the low FC mode when the developing unit driving period counted by the image formation period counter 22 reaches the predetermined value (mode changeable timing) even in a state that the copier 1 has been set at the high FC mode by manipulation of the FC mode selecting key 1041. This arrangement prevents likelihood that toner density may be excessively high when the developing unit driving period counted by the image formation period counter 22 exceeds the predetermined value. With this arrangement, even if the developing unit driving period exceeds the predetermined value (mode changeable timing), the copier 1 is enabled to maintain its image density at a constant level, thereby eliminating or suppressing poor image formation due to fluctuating or unstable image density, and ensuring desired image quality.

It should be noted that when copying operation of the copier 1 is continued at the high FC mode, it is highly likely that toner density may be gradually increased as the developing unit driving period lapses. In view of this, it is preferable to provide the image formation period counter 22 for counting the image formation period (developing unit driving period), and the mode changer 24 for changing the copier from the high FC mode to the low FC mode at a timing (mode changeable timing) at which the value counted by the counter 22 reaches the predetermined value in a state that the copier 1 has been kept at the high FC mode by the FC mode selecting key 1041. With this arrangement, excessive rising of toner density accompanied by excessive lapse of the image formation period can be suppressed. With this arrangement, the copier 1 is enabled to maintain its image density at a constant level even after the image formation period counted by the image formation period counter 22 exceeds the predetermined value, thereby eliminating or suppressing poor image formation due to excessively high toner density, and ensuring desired image quality. The predetermined value is a timing at which the toner density becomes excessively high with the operation of the copier 1 being continued at the high FC mode, and is calculated, e.g., based on an actual measurement with respect to a copier before shipment.

(Second Embodiment)

Figure 8:
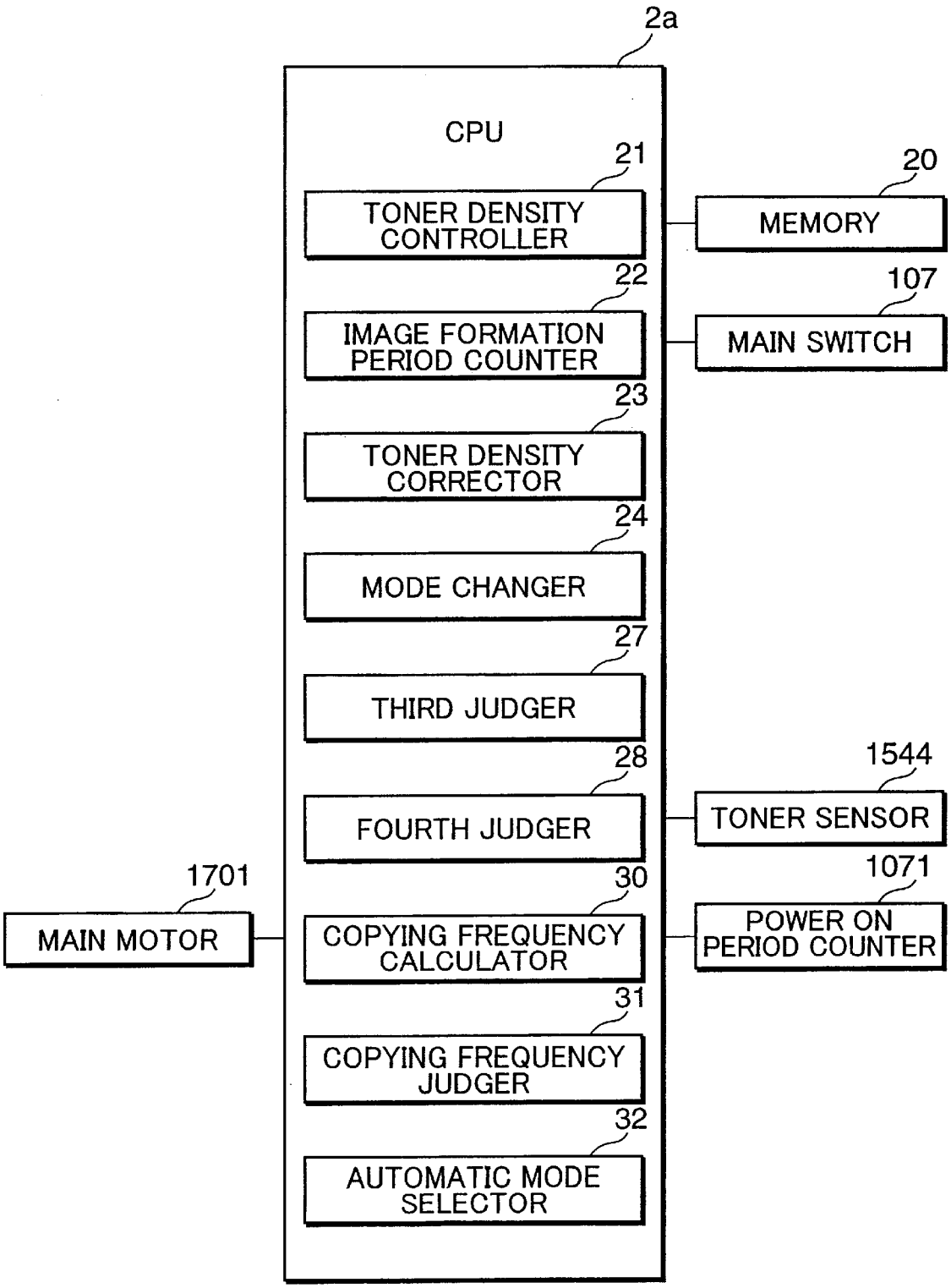
FIG. 8 is a block diagram showing a control system in relation to a developing unit of the copier in accordance with the second embodiment.
Figure 9:
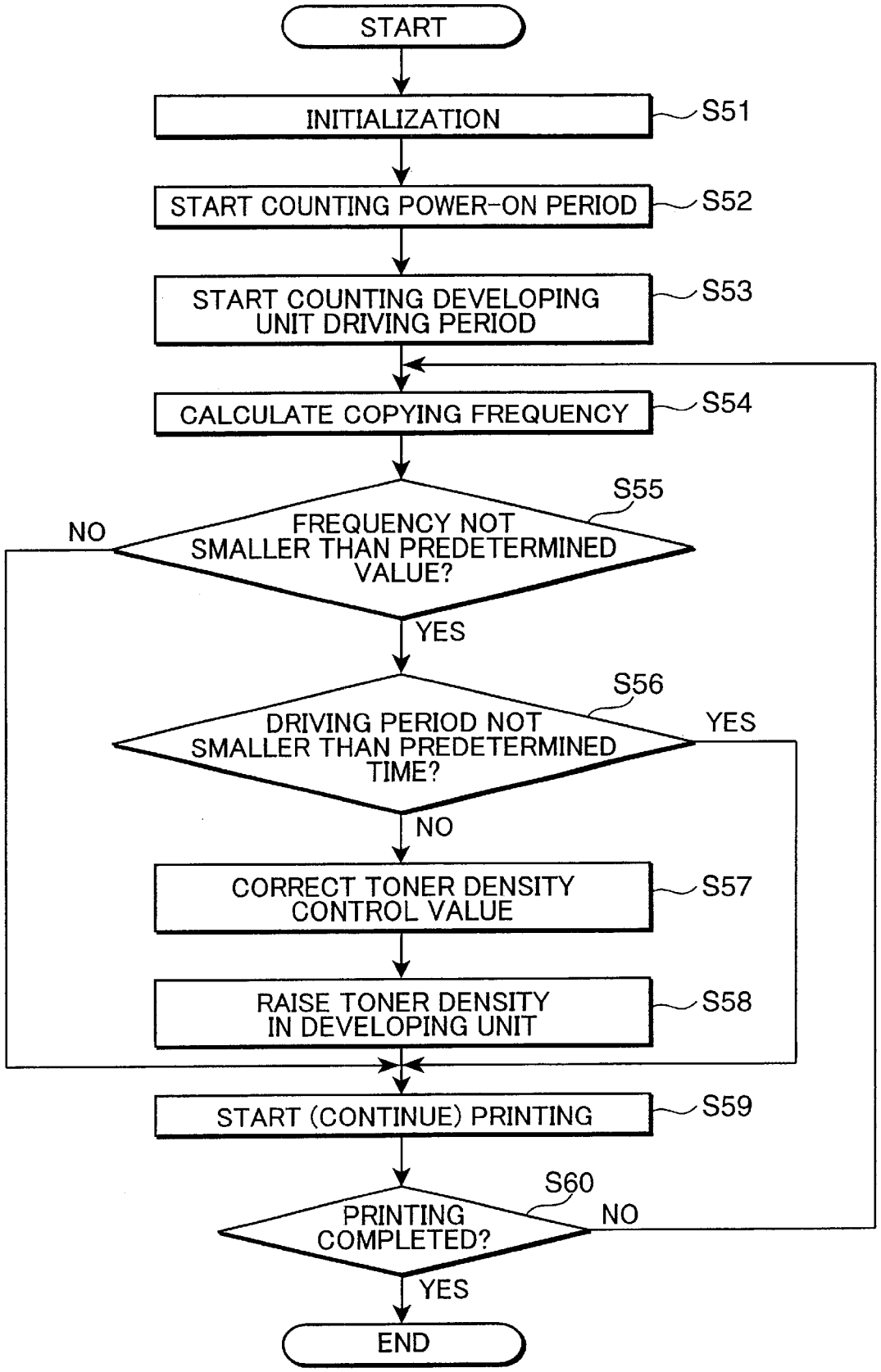
FIG. 9 is a flowchart showing a control operation of the copier in relation to the developing unit in the second embodiment.

The second embodiment is different from the first embodiment in that the mode selection is automatically performed in the second embodiment, whereas the mode selection is manually designated in the first embodiment. The second embodiment is described with reference to FIGS. 8 and 9. FIG. 8 is a block diagram showing a control system in relation to a developing unit of a copier in accordance with the second embodiment, and FIG. 9 is a flowchart showing a control operation of the copier in association with the developing unit. It should be noted that elements in the second embodiment which are identical to those in the first embodiment are denoted at the same reference numerals as the first embodiment, and a description thereof is omitted herein.

Referring to FIG. 8, the control system of the second embodiment includes a power on-time counter 1071 for counting a period from a timing at which a main switch 107 is turned on to a timing at which the main switch 107 is turned off. The control system includes a CPU 2*a*, and the CPU 2*a* is provided with a copying frequency calculator 30 (copying frequency detector), a copying frequency judger 31 (judger), and an automatic mode selector 32. The copying frequency calculator 30 has a function of computing the copying frequency, i.e., the number of times of image formation per unit time calculated by, for example, dividing a developing unit driving period counted by an image formation period counter 22 by a power-on period counted by the power on-time counter 1071. The copying frequency judger 31 has a function of judging whether the calculated copying frequency is not smaller than a predetermined value. The automatic mode selector 32 has a function of automatically changing the mode of the copier 1 from the low FC mode to the high FC mode when the copying frequency judger 31 judges that the copying frequency calculated by the copying frequency calculator 30 is equal to or larger than the predetermined value.

It should be appreciated that each of the elements 30 through 32 is activated by an execution program which is, for example, read out from a memory 20 and brought to an operable state in the CPU 2*a*, similar to the elements 21 through 28 in the first embodiment.

Referring to FIG. 9, for instance, when a user turns on the main switch 107 to supply power to the copier 1, the copier 1 is initialized (Step S51). In the initialization, a value counted by the image formation period counter 22 and a value counted by the power on-time counter 1071 are reset respectively, and the power on-time counter 1071 starts counting an ON-state period of the copier 1 (Step S52). Then, the copier 1 starts warming up. When the copier 1 is brought to a stand-by state ready for copying, the image formation period counter 22 starts counting a developing unit driving period (Step S53).

Subsequently, the copying frequency calculator 30 calculates a copying frequency by dividing the developing unit driving period counted by the image formation period counter 22 by the power-on period counted by the power on-time counter 1071 (Step S54). Then, in Step S55, the copying frequency judger 31 judges whether the copying frequency is not smaller than the predetermined value (e.g., in this embodiment, the predetermined value is an arbitrary number n (n is an integer) selected from a range of 1,500 to 3,000 sheets per month). The predetermined value is stored in advance in the memory 20. If it is judged that the copying frequency is smaller than the predetermined value (NO in Step S55), the routine proceeds to Step S59 while skipping Steps S56 through S58, and then goes to Step S60. Steps S59, S60 correspond to Steps S12, S13 in the first embodiment, respectively.

If it is judged that the copying frequency is not smaller than the predetermined value (YES in Step S55), Step S56 through S60 are carried out. Steps S56 through S60 correspond to Steps S9 through S13 in the first embodiment, respectively.

Steps S53 through S60 are cyclically repeated until it is judged that printing is completed in Step S60 (YES in Step S60). When it is judged that printing is completed in Step S60 (YES in Step S60), the routine ends.

As mentioned above, the CPU 2*a* in the second embodiment includes the copying frequency calculator 30 for calculating the copying frequency, the copying frequency judger 31 for judging whether the calculated value is not smaller than the predetermined value, and the automatic mode selector 32 for automatically selecting the high FC mode when the copying frequency judger 31 judges that the calculated value is not smaller than the predetermined value. In this arrangement, since the mode selection is automatically performed based on a judgment result of the copying frequency judger 31, there is no need of manual designation by a user.

It should be appreciated that this invention is not limited to the foregoing embodiment, and various modifications and alterations are applicable without departing from the scope and spirit of the invention as defined by attached claims. Followings are examples of such modifications or alternations.

(1) Manual mode selection is performed in the first embodiment, and automatic mode selection is performed in the second embodiment. Alternatively, manual mode selection and automatic mode selection may be used in combination. Specifically, in the automatic mode selection, it takes a certain time for the CPU 2*a* to judge whether the copying frequency exceeds a predetermined value. In view of this, in the altered arrangement, the automatic mode selection may be implemented when a user does not know whether he or she is a high FC user or a low FC user (namely, the user does not grasp the copying frequency) whereas a user may be allowed to manually designate the high FC mode when the user knows that he or she is a high FC user having a task of a bulky number of copying without waiting for the predetermined time required in the case where the copier is set at the automatic mode selection. With such an altered arrangement, the copier can cope with different copying demands of users in a sophisticated manner.

(2) In the first embodiment, the FC mode selecting key 1041 and the display panel 1042 are individually provided. Alternatively, the FC mode selecting key 1041 and the display panel 1042 may be formed integral. For instance, the FC mode selecting key 1041 may be a switch operable as a software and displayed as such on the display panel 1042.

(3) In the first and second embodiments, the copier is described as an example of the image forming apparatus in accordance with this invention. This invention is not limited to a copier and may be applicable to an electrophotographic image forming apparatus such as a facsimile machine and a printer.

(4) In the first and second embodiments, toner density is controlled based on a detection result of the toner sensor 1544 which detects variation of magnetic permeability. In case of an image forming apparatus having a transfer belt for transporting copy paper to a photosensitive drum for image transfer, it may be possible to form a test patch on the photosensitive drum at a position corresponding to a space between a copy paper and another copy paper fed through the transfer belt to allow an optical sensor to detect the test patch for detecting toner density thereat so as to control the toner density.

This application is based on Japanese patent application No. 2001-365698 filed on Nov. 30, 2001, the contents of which are hereby incorporated by references.

As this invention may be embodied in several forms without departing from the spirit of essential characteristics thereof, the present embodiment is therefore illustrative an not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. An image forming apparatus comprising:

a toner density detector for detecting a density of toner contained in a two-component developing agent adapted to be used in image formation;

a toner density controller for controlling the toner density detected by the toner density detector to a target value:

a mode selector for allowing a user to selectively designate a low frequent image-forming mode indicating that the image forming apparatus is in a less-used state where a frequency of the image formation is smaller than a predetermined value and a high frequent image-forming mode indicating that the image forming apparatus is in a highly-used state where the frequency of the image formation is not smaller than the predetermined value; and a toner density corrector for correcting the target value of the toner density in response to designation of the high frequent image-forming mode by the mode selector in such a manner that the toner density controller controllably adjusts the toner density to equal a higher target value which is a larger value than a lower target value corresponding to the state where the image forming apparatus is in the low frequent image-forming mode.

2. The image forming apparatus according to claim 1, further comprising:

an image formation period counter for counting a period of operating the image forming apparatus for an image formation; and a mode changer for changing the mode of the image forming apparatus from the high frequent image-forming mode to the low frequent image-forming mode at a timing at which a value counted by the image formation period counter reaches a predetermined value at which time it is expected that the image forming apparatus is recovered from an insufficient charging status by lapse of a certain image formation period while the apparatus is set in the high frequent image-forming mode.

3. The image forming apparatus according to claim 1, wherein the mode selector includes a display section for allowing the user to designate the mode selection.

4. The image forming apparatus according to claim 2, wherein the mode selector includes a display section for allowing the user to designate the mode selection.

5. The image forming apparatus according to claim 1, further comprising:

an image formation frequency detector for detecting an image-forming frequency; and a judger for judging whether the image forming apparatus is in the high frequent image-forming mode or in the low frequent image-forming mode based on a detection result by the image formation frequency detector, and wherein the mode selector automatically selects the high frequent image-forming mode when the judger judges that the image forming apparatus is operated in the high frequent image-forming mode.

6. The image forming apparatus according to claim 2, further comprising:

an image formation frequency detector for detecting an image-forming frequency; and a judger for judging whether the image forming apparatus is in the high frequent image-forming mode or in the low frequent image-forming mode based on a detection result by the image formation frequency detector, and wherein the mode selector automatically selects the high frequent image-forming mode when the judger judges that the image forming apparatus is operated in the high frequent image-forming mode.

7. An image forming apparatus, which is generally intended for the ordinary use with copying making frequency of 1,500 to 3,000 sheets per month, said image forming apparatus comprising:

a toner density detector for detecting a density of toner contained in a two-component developing agent adapted to be used in image formation;

a toner density controller for controlling the toner density detected by the toner density detector to a target value:

a mode selector for allowing a user to selectively designate a low frequent copying mode indicating that the image forming apparatus is in a less-used state where a frequency of the image formation is smaller than 3,000 sheets per month and a high frequent copying mode indicating that the image forming apparatus is in a highly-used state where the frequency of the image formation is equal to or larger than 3,000 sheets per month; and a toner density corrector for correcting the target value of the toner density in response to designation of the high frequent copying mode by the mode selector in such a manner that the toner density controller controllably adjusts the toner density to equal a higher target value which is a larger value than a lower target value corresponding to the state where the image forming apparatus is in the low frequent copying mode.

8. An image forming apparatus, which is generally intended for the ordinary use with copying making frequency of 1,500 to 3,000 sheets per month, said image forming apparatus comprising:

a toner density detector for detecting a density of toner contained in a two-component developing agent adapted to be used in image formation;

a toner density controller for controlling the toner density detected by the toner density detector to a target value;

a copying frequency calculator (30) for calculating copying frequency;

a copying frequency judger (31) for judging if or not the calculated copying frequency is higher than a first predetermined value;

a mode selector including an automatic mode selector (32) for selectively designating a low frequent copying mode where a frequency of the image formation is smaller than a second predetermined value and a high frequent copy mode where the frequency of the image formation is equal to or larger than the second predetermined value, and said automatic mode selector (32) changes the copying mode from the low frequent copying mode to the high frequent copying mode when it is judged by the copying frequency judger (31) that the copying frequency is higher than the first predetermined value; and a toner density corrector for correcting the target value of the toner density in response to designation of the high frequent copying mode by the mode selector in such a manner that the toner density controller controllably adjusts the toner density to equal a higher target value which is a larger value than a lower target value corresponding to the state where the image forming apparatus is in the low frequent copying mode.

9. The image forming apparatus according to claim 8, wherein the copying frequency calculator (30) calculates the copying frequency based on the summation of the image forming operation time periods within a certain time period in which the image forming apparatus is maintained in ON state.

10. The image forming apparatus according to claim 9, wherein the mode selector further includes a manual mode selector for allowing a user to selectively designate a low frequent copying mode where the frequency of the image formation is smaller than a preset value and a high frequent copy mode where the frequency of the image formation is equal to or larger than the preset value.

11. The image forming apparatus according to claim 10, wherein the manual mode selector allows the user to selectively change the copying mode from the low frequent copying mode to the high frequent copying mode disregarding the copying mode designated by the automatic mode selector.

* * * * *